US006202761B1

(12) United States Patent
Forney

(10) Patent No.: US 6,202,761 B1
(45) Date of Patent: Mar. 20, 2001

(54) DIRECTIONAL DRILLING METHOD AND APPARATUS

(75) Inventor: Larry R. Forney, Fresno, TX (US)

(73) Assignee: Goldrus Producing Company, Houston, TX (US)

( * ) Notice: Subject to any disclaimer, the term of this patent is extended or adjusted under 35 U.S.C. 154(b) by 0 days.

(21) Appl. No.: 09/303,777

(22) Filed: Apr. 30, 1999

Related U.S. Application Data

(60) Provisional application No. 60/083,710, filed on Apr. 30, 1998.

(51) Int. Cl.[7] ..... E21B 7/08

(52) U.S. Cl. ..... 175/61; 175/80; 175/81

(58) Field of Search ..... 175/61, 62, 73, 175/76, 78, 80, 81; 166/50

(56) References Cited

U.S. PATENT DOCUMENTS

| | | | |
|---|---|---|---|
| 2,585,207 | 2/1952 | Zublin . | |
| 4,328,839 | 5/1982 | Lyons et al. | 138/120 |
| 4,343,369 | 8/1982 | Lyons et al. | 175/75 |
| 4,600,037 | 7/1986 | Hatten | 138/120 |
| 4,653,598 | 3/1987 | Schuh et al. | 175/75 |
| 4,938,298 | 7/1990 | Rehm | 175/61 |
| 5,584,350 * | 12/1996 | Schnitker et al. | 175/61 |
| 5,853,056 * | 12/1998 | Landers | 175/62 |

OTHER PUBLICATIONS

Lanier; Low–Cost Short Radius Re–Entry Horizontal Drilling Program Revitalizes Aging Northern Michigan Niagaran Oil Fields; Society of Petroleum Engineers; 1996.

Warren, et al.; Shorr–Radius Lateral Drilling System; JPT; Feb. 1993, pp. 108–115.

Warren; Slimhole Rotary Steerable System Broadens Applications; World Oil; Sep. 1997; pp. 83–97.

Warren; Trends Toward rotary Steerable Directional Systems; World Oil; May 1997; pp. 43–47.

* cited by examiner

*Primary Examiner*—William Neuder
(74) *Attorney, Agent, or Firm*—Larry R. Forney

(57) ABSTRACT

A directional or horizontal hole may be drilled into a formation by first positioning or orienting a window turning shoe in an original well bore. Once the window turning shoe has been positioned, a window is milled through the casing with a window mill. The window mill is then removed and a guide tool is then latched to the window turning shoe. Once in position, the guide tool enables a mechanical motor driven curve drilling assembly to create a curved hole. Following the completion of the curved hole, the directional or horizontal hole is extended with a conventional drilling assembly.

7 Claims, 7 Drawing Sheets

DIRECTIONAL DRILLING METHOD AND APPARATUS

This application claims the benefit of U.S. Provisional Patent Application Ser. No. 60/083,710 filed Apr. 30, 1998.

FIELD

The present invention pertains to well drilling methods and equipment; more particularly, the present invention pertains to a method and equipment used for drilling directional or horizontal holes away from a vertical well bore.

BACKGROUND

There are many oil and gas fields that have a significant percentage of their reserves still remaining in the underground formation. Yet wells in these oil and gas fields are only producing at rates which render these wells only marginally profitable. This marginal profitability is due to the characteristic rapid production decline of many reservoirs. This rapid production decline has resulted in the majority of the proven reserves being produced at low rates over many years. Production declines can be attributed to a variety of causes including: water and/or gas coning, compartmentalization of the reservoir, poor horizontal permeability, well bore skin damage and reservoir pressure depletion.

In recent years it has been found that directional or horizontal well drilling technology can make a direct positive impact on all of these reservoir problems, thereby increasing well production rates and ultimate reserve recovery. Unfortunately, directional or horizontal well drilling requires the use of expensive steering tools and complex monitoring equipment. For many well operators, the complexity and associated cost of directional or horizontal drilling into previously untapped reserves is prohibitive and not economically justifiable. There remains, therefore, a need in the art for a method and apparatus that can reliably drill directional and horizontal wells at a relatively low cost.

SUMMARY

The method and apparatus of the present invention provides a low cost, reliable method and apparatus to drill one or more short radii directional or horizontal holes from an existing substantially vertical well bore. Utilized in the disclosed method and apparatus are three components, as follows:

1. Window turning shoe with an on-off guide tool: This tool combination facilitates the milling of an opening in the production casing of the original well bore and then provides for the mechanical orientation and guidance of the mechanical curve building assembly.
2. Mechanical curve building assembly: This mechanical tool assembly drills an arcuate well bore outwardly from the original well bore.
3. Mud motor driven drilling tool assembly: The mud motor driven curve drilling tool assembly drills an arcuate well bore outwardly from the original well bore.

BRIEF DESCRIPTION OF THE DRAWING FIGURES

A better understanding of the directional drilling method and apparatus of the present invention may be had by reference to the drawing figures, wherein.

Figure 9A:
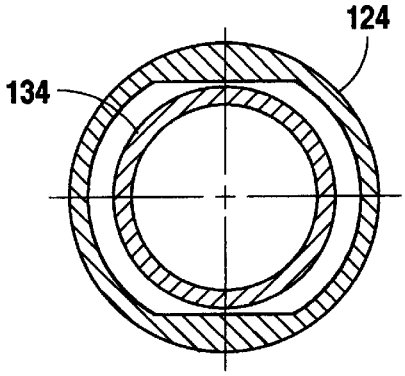
Figure 9B:
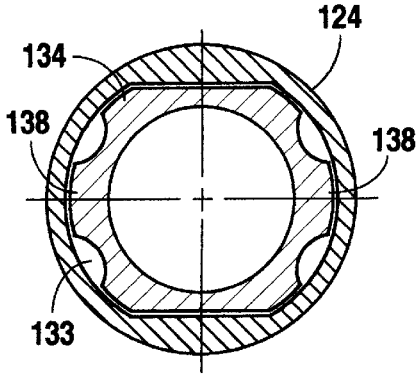
Figure 9C:
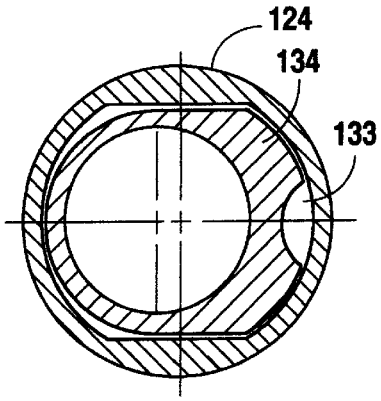
Figure 9D:
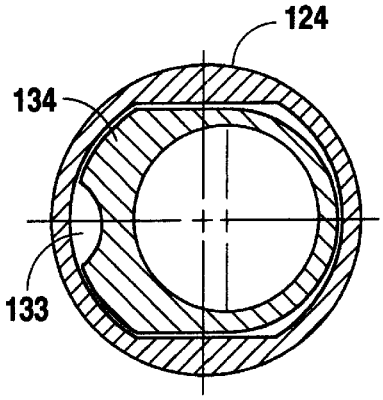
Figure 10:
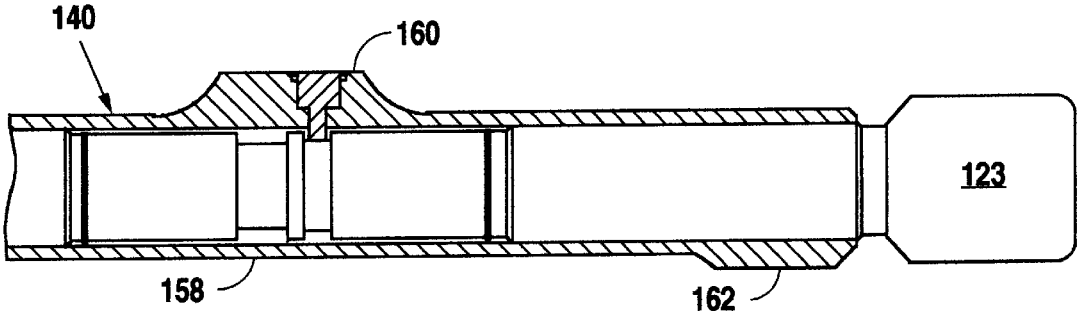

FIGS. 9A, 9B, 9C, and 9D displays various horizontal cross-sections of the mechanical drilling tool and the non-rotating sleeve engaged in the on-off guide tool; and FIG. 10 is a side elevational view in partial cross-section of the mechanical drilling tool.

Figure 1:
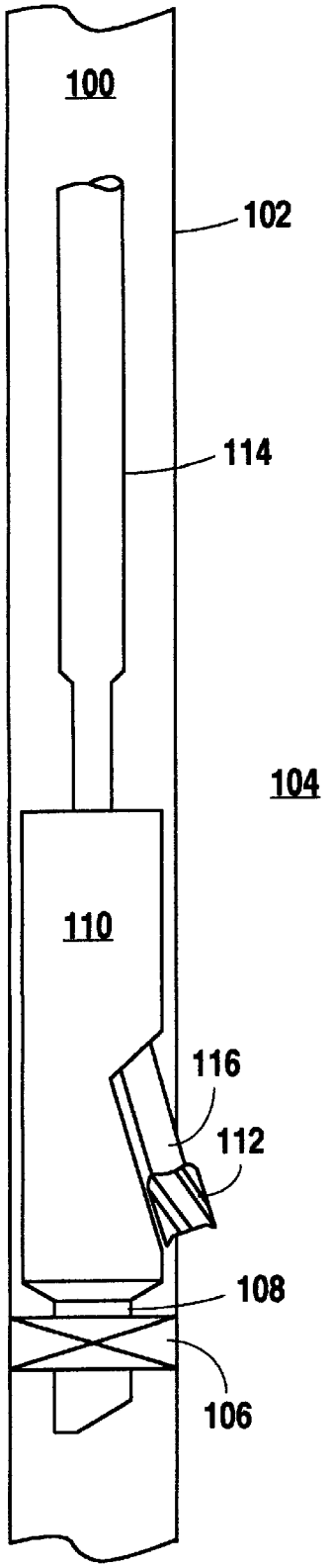
FIG. 1 is a schematic elevational view, of an original well bore and the surrounding formation showing the milling of a hole through the production casing using the window turning shoe of the present invention.
Figure 11:
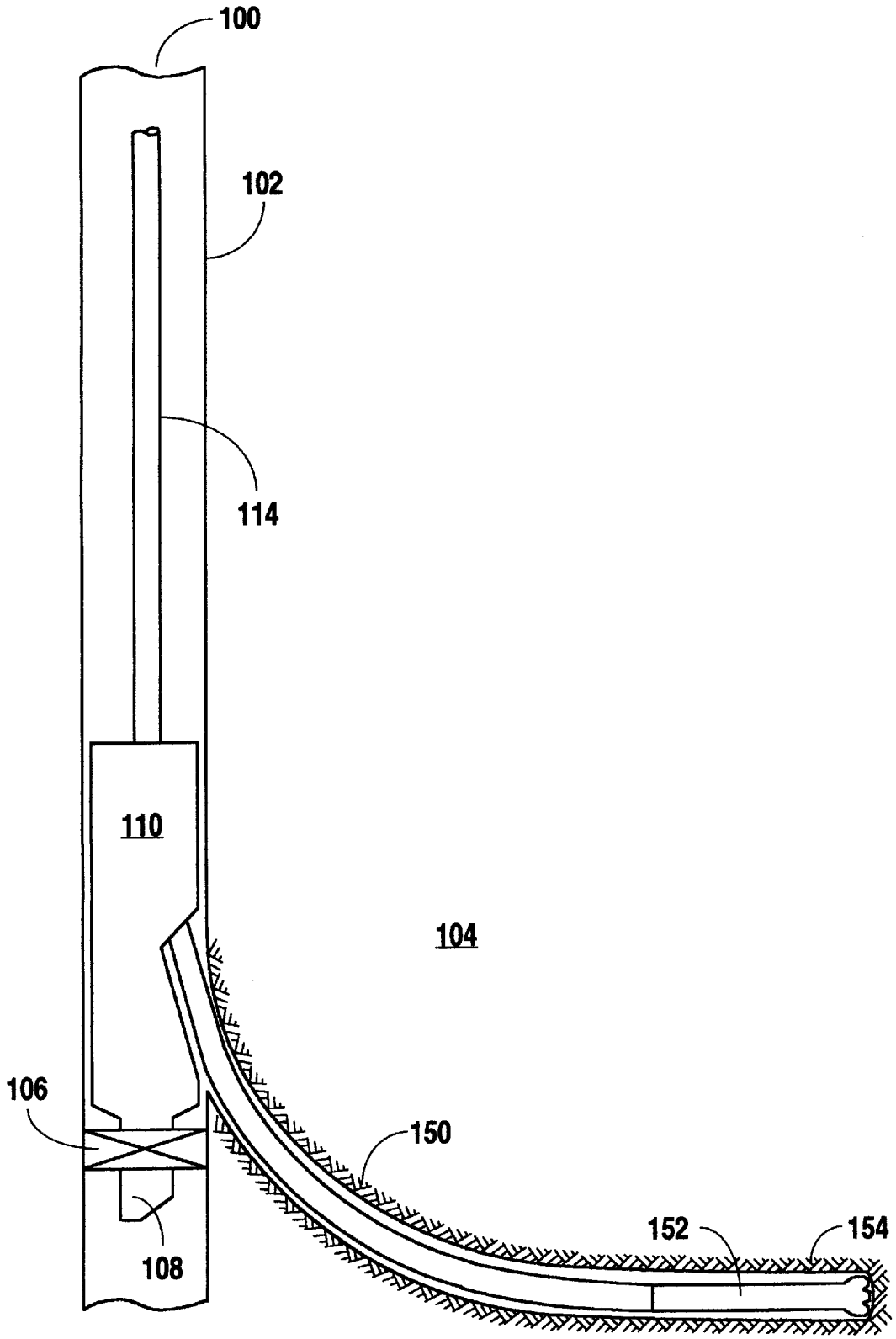

FIG. 11 is a view similar to FIG. 1 of a well bore and the surrounding formation showing the utilization of the window turning shoe and the lateral drilling assembly of the present invention to extend a lateral hole away from the original substantially vertical well bore;

DESCRIPTION OF THE EMBODIMENTS

A better understanding of the directional drilling method and apparatus of the present invention may be had by understanding the steps taken to drill first an arcuate hole then a directional or horizontal hole away from an original well bore.

ESTABLISHING THE DEPTH AND THE ORIENTATION FOR THE DIRECTIONAL OR HORIZONTAL HOLE

1. As may be seen by reference to FIG. 1, a directional or horizontal hole into the formation surrounding the casing begins with cutting or milling a window through the casing 102 in an original well bore 100 to gain access to the surrounding formation 104.

2. A conventional whipstock type packer 106 with an integral latch profile (not shown) is set and tied into the production casing 102 at the desired depth with an electric line unit.

3. Once the packer 106 has been set and tied into the casing 102, the directional heading of the integral latch profile's orientation key (not shown) is determined.

MILLING A WINDOW THROUGH THE CASING

Figure 2:
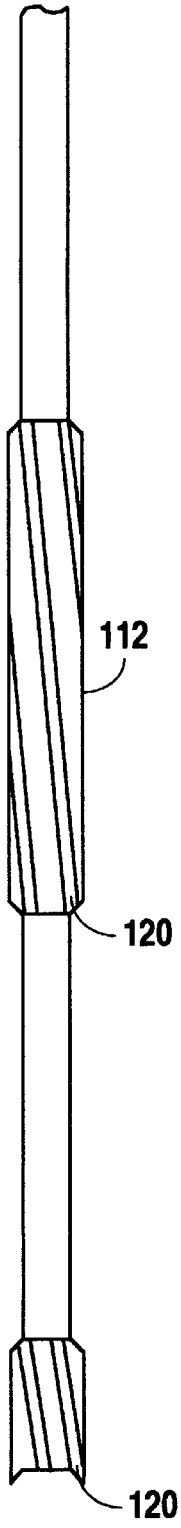
FIG. 2 is a side elevational view of a typical window milling assembly.

4. A packer anchor 108 is attached to the bottom of a window turning shoe 110. The packer anchor assembly 108 orients the window turning shoe 110 in the proper direction by contact with the integral latch profile's orientation key. The window mill 112 (FIG. 2) is stabbed into the window turning shoe 110 and pinned in place.

5. The window turning shoe 110 with a properly oriented packer anchor assembly 108 together with the window assembly 112 is run into the hole on the workstring 114.

6. The packer anchor assembly 108 is inserted into the whipstock type packer 106 where it is secured in place.

7. The necessary force is applied to the workstring 114 to disengage the shear pins (not shown) which hold the window assembly 112 to the window turning shoe 110.

Figure 3:
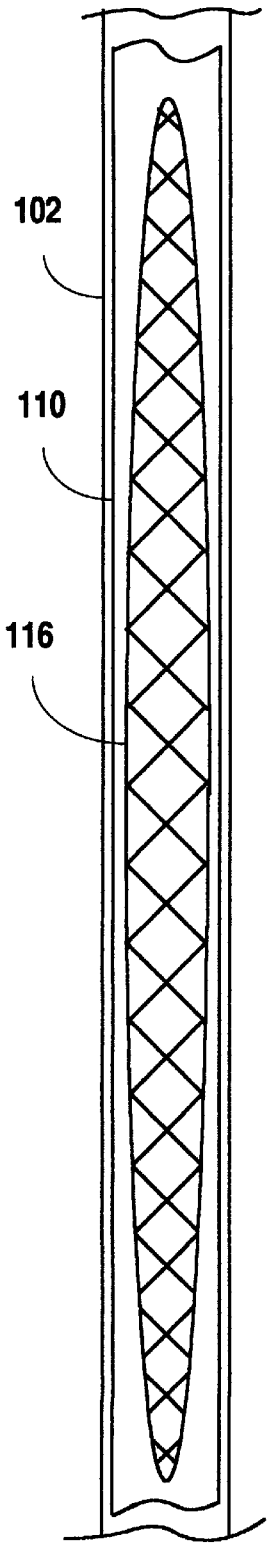
FIG. 3 is a front elevational view of the window produced in the casing.
Figure 3A:
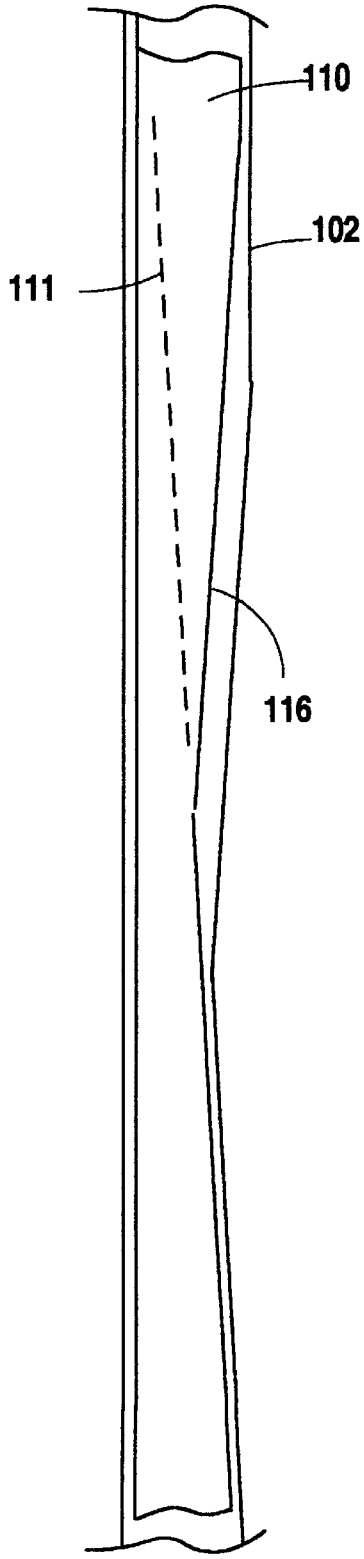
FIG. 3A is a side elevation of the casing shown in FIG. 3.
Figure 7:
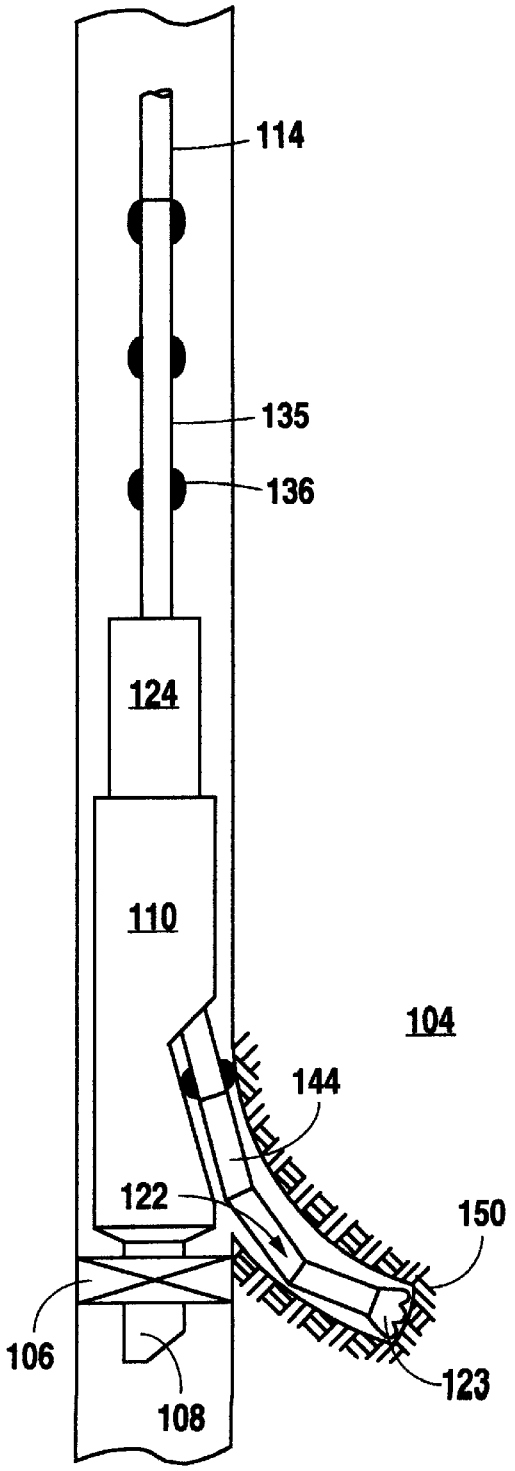
FIG. 7 is a view similar to FIG. 1 of an original well bore and the surrounding formation showing the utilization of the window turning shoe with the on-off guide tool and the mud motor building assembly of the present invention in the midst of drilling an arcuate well bore from the window milled in the production casing.

8. A window 116 (FIGS. 3 and 3A) is cut through the casing 102 as shown in FIG. 7 by rotating the workstring 114 with a designated WOB (weight on bit) and RPM (revolution per minute). The conforming wedge face 111 within the window turning shoe 110 turns the window mill 112 into the casing 102. Once the window 116 has been cut through the casing 102 a pilot hole (not shown) is drilled into the formation 104 beyond the casing wall 102. This pilot hole assists in beginning the drilling of a curved hole 150 described in the following steps. Rotation of the workstring 114 causes rotation of the window mill 112 shown in FIG. 2. Because of the vertical directional change imparted in the window milling tool 112 by the conforming wedge face 111 in the window turning shoe 110, the turning of the window milling shoe 112 causes the teeth 120 on the window milling shoe 112 to cut through the casing 102.

9. Once a window 116 has been milled through the casing 102 the window assembly 112 is pulled out of the hole 100. The window turning shoe 110, packer anchor assembly 108 and packer 106 all remain in place in the hole 100.

DRILLING THE CURVED HOLE

Figure 6:
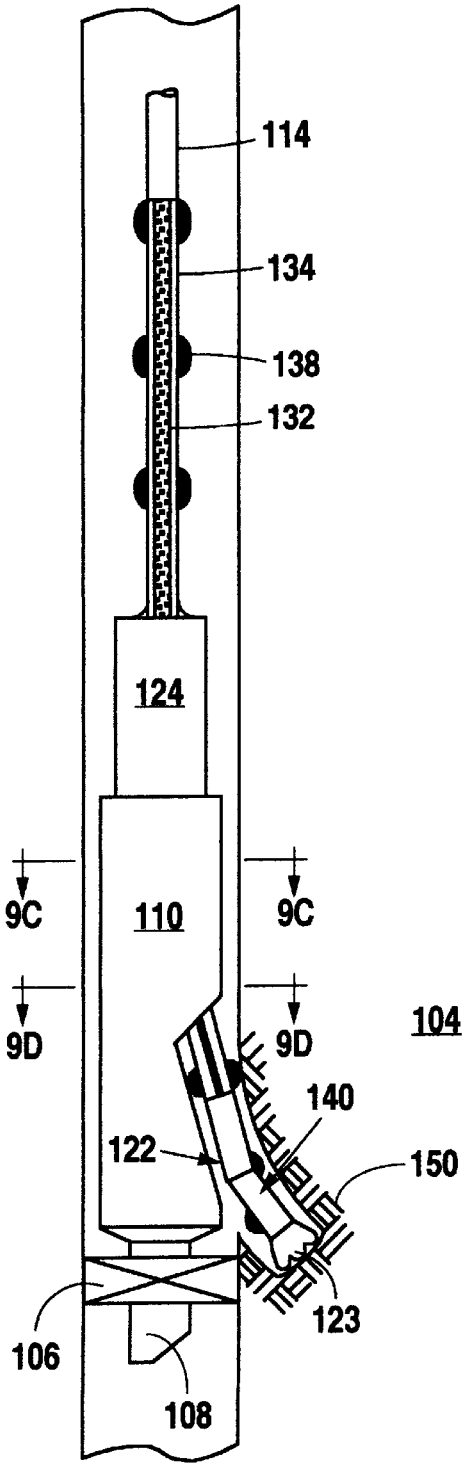
FIG. 6 is a view similar to FIG. 1 of an original well bore and the surrounding formation showing the utilization of the window turning shoe with the on-off guide tool and the mechanical curve building assembly of the present invention beginning the drilling of an arcuate hole away from the window milled in the production casing.

10. The curve building assembly 122 is made up by stabbing the mechanical curve drilling tool assembly 140 or mud motor assembly 144 through the on-off guide tool 124(FIGS. 6 and 7).

11. The on-off guide tool 124 together with the curve building assembly 122 are run into the well bore 100 on the workstring 114.

Figure 4A:
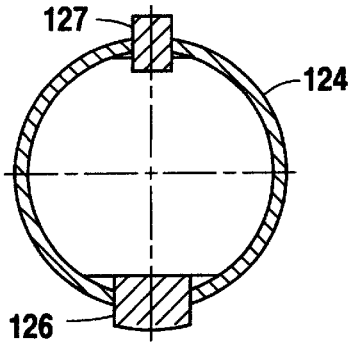
FIG. 4A is a horizontal cross-sectional view of the male portion of the on-off guide tool latch assembly.
Figure 4C:
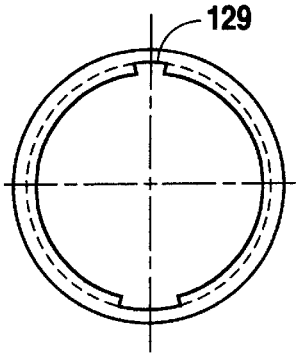
FIG. 4C is a horizontal cross-sectional view of the top of the female portion of the window turning shoe latch assembly.
Figure 4B:
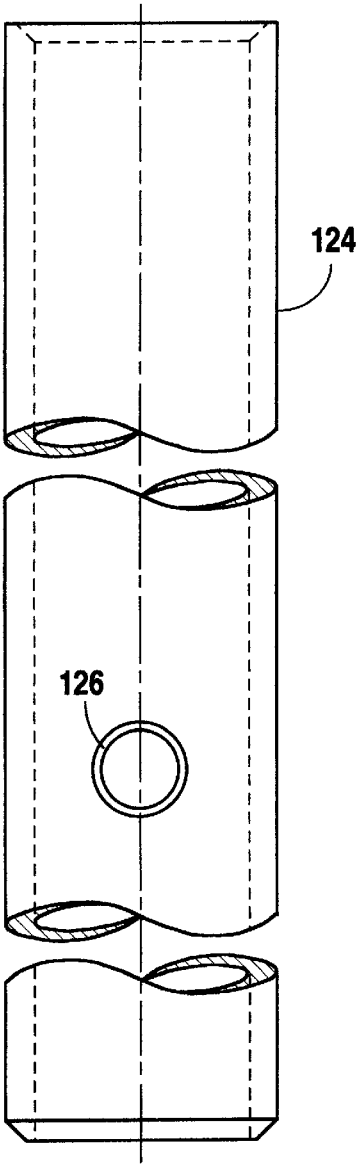
FIG. 4B is a side elevational view of the male portion of the on-off guide tool latch assembly.
Figure 4D:
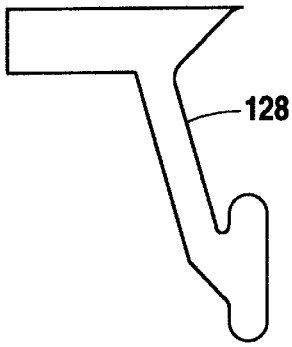
FIG. 4D is an elevational view of the female portion of the window turning shoe latch assembly.

12. The on-off guide tool 124 is inserted into the window turning shoe 110 and "J" latched into place within the window turning shoe 110. While a "J" latch mechanism is shown in the preferred embodiment, those of ordinary skill in the art will understand that equivalent latching may be used. As shown in FIGS. 4A and 4B, the on-off guide tool 124 includes a pin 126, 127 on either side. These pins 126,127 slide into the top 129 of a "J" slot 128 (see FIGS. 4C and 4D) within the window turning shoe 110. As shown in FIG. 4C the opening to the tope of the "J" slots 128 on either side of the inside of the window turning shoe 110 are of different sizes to assure the orientation of the curve building assembly 122 in the proper direction.

13. The force necessary to disengage the shear pins (not shown) which hold the curve building assembly 122 to the on-off-guide tool 124 is applied to the workstring 114.

Figure 5:
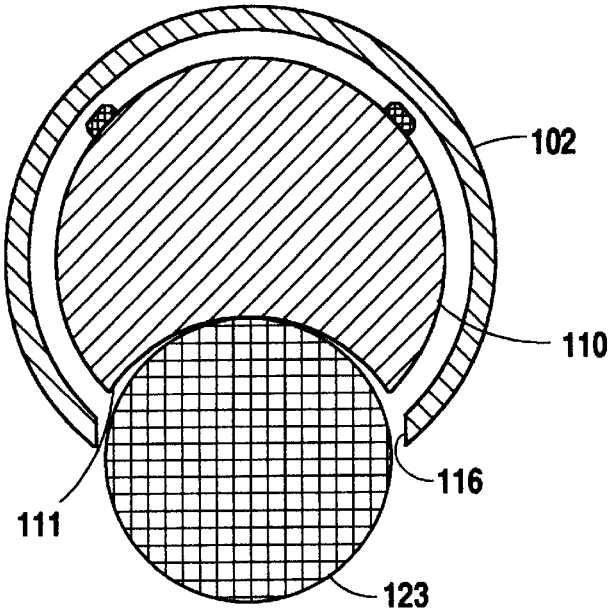
FIG. 5 is a horizontal cross-sectional view across a drill bit, the window turning shoe and the casing at the center of the casing window.
Figure 8:
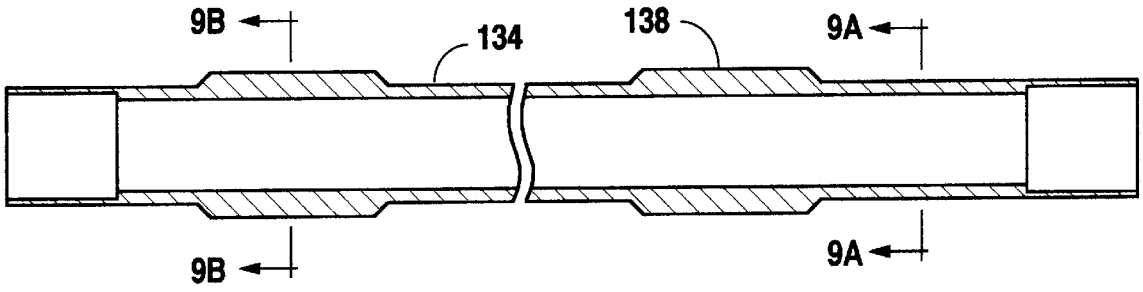
FIG. 8 is a cross-sectional view of the non-rotating sleeve.

14. An arcuate or curved hole 150 is drilled by passing the bit 123 (FIG. 10) on the end of the curve drilling tool assembly 122 through the casing window 116 (FIG. 5) using procedures specific to the curve drilling tool assembly 122 (FIGS. 6 and 7) being utilized. Progress in drilling the arcuate hole 150 is surveyed as necessary. As shown in FIG. 6 a torque tube 132 within a non-rotating sleeve 134 (FIG. 8) is used to transmit torque from the workstring 114 to the curve drilling tool assembly 122 shown in FIG. 10. Shown in FIG. 9A is a cross-section of the non-rotating sleeve 134 within the on-off guide tool 124. This cross-sectional view is taken between the stabilizers 138 on the non-rotating sleeve 134 as shown in FIG. 8. FIG. 9B is a cross-section of the stabilizers 138 as shown in FIG. 8. Proper orientation of the mechanical drilling tool assembly 140 driven by a mud motor (not shown) and contained within curve building assembly 122 is controlled by the on-off guide tool 124. As may be seen in FIGS. 6, 9C and 9D the on-off guide tool 124 guides and maintains the proper orientation of the non-rotating sleeve 134 and torque tube 132. This is done in a similar fashion for the stabilized tube 135. Water courses 133 are provided as needed.

15. Once the curved hole 150 has been drilled, the curve building assembly 122 is removed from the well bore 100 along with the on-off guide tool 124 by unlatching the on-off guide tool 124 from the window turning shoe 110. The window turning shoe 110, packer anchor assembly 108, and packer 106 all remain in place within the well bore 100.

CREATING A DIRECTIONAL OR HORIZONTAL HOLE

16. A conventional drilling assembly 152 is run into the well bore 100 through the curved hole 150 to extend the hole 154 laterally as desired (FIG. 11). When complete, the drilling assembly 152 is removed from the well bore 100.

17. To remove the window turning shoe 110 a pulling tool (not shown) with the on-off latch profile is run into the well bore 100. The pulling tool is latched into window turning shoe 110. The force necessary to disengage the anchor assembly 108 from packer 106 is applied to the worksting 114 to remove the window turning shoe 110 and the anchor assembly 108. The packer 106 remains in place.

Multiple directional or horizontal holes may be drilled by repeating the foregoing procedures at various depths and orientations within the well bore 100.

FEATURES AND ADVANTAGES OF THE WINDOW TURNING SHOE WITH ON-OFF GUIDE TOOL

The following features and advantages of using the window turning shoe 110 with the on-off guide tool 124 are listed below:

A. Use of the disclosed method and apparatus allows for a one trip operation to execute the following:
   1. run the window turning shoe 110 with the packer anchor assembly 108 and milling assembly 112 into the hole 100;
   2. latch into a packer 106;
   3. mill a window 116 in the production casing 102 (at a pre-set directional orientation);
   4. leave the window turning shoe 110 in place while retrieving the window milling assembly 112 from the hole 100.

B. Use of the disclosed apparatus and method allows for milling of the casing window 116 in one trip, building a curved hole 150 in a second trip and drilling a directional or horizontal hole 154 on a third trip.

C. Multiple trips may be conducted through the window turning shoe 110 for window milling, curve building and lateral drilling operations. Upon the completion of the lateral drilling operations, the window turning shoe 110 and packer anchor assembly 108 can be retrieved from the hole 100.

D. Use of the disclosed apparatus and method allows the window milling assembly 112 to cut through the casing wall 102 at a constant desired angle. This angle is maintained by providing a conforming wedge face 111 in the window turning shoe 110 to both guide and support the window milling assembly 112 through its cutting of a window 116 in the casing wall 102.

E. Use of the disclosed apparatus and method results in a milled window 116 through the casing wall 102 having known dimensions and oriented in a known direction.

F. The window milling assembly 112 allows the entire window 116 to be cut in the casing wall 102 with one run of the window milling assembly 112 into the bore hole 100.

G. The connection on the bottom of the window turning shoe 110 can be readily made up with conventional downhole accessories.

H. Use of the disclosed apparatus and method allows the workstring 114 to bend at a desired normal curve as it passes through the window turning shoe 110.

I. The "J" slot latch 128 within the window turning shoe 110 receives and positions the on-off guide tool 124.

J. The on-off guide tool 124 serves as a positive orientation guide for the curve drilling tool assembly 122.

K. The on-off guide tool 124 fixes the orientation of the curve building assembly 122, thereby eliminating the need for a gyro when drilling of the curved hole 150 into the formation 104 outside the milled window 116 in the casing 102.

L. Eliminating the need of a gyro allows for the use of smaller tubulars, (2-1/16" tubing and less). Smaller tubulars allow for shorter turning radii.

M. The utilization of extensions of various lengths (not shown), between the window turning shoe 110 and the packer anchor assembly 108, allows for multiple lateral holes to be drilled outwardly from one well bore, and then ultimately produced simultaneously. These multilateral well bores can be at various predetermined depths and in various directional orientations, as desired.

FEATURES AND ADVANTAGES OF THE MECHANICAL CURVE DRILLING ASSEMBLY

A. The non-rotating sleeve 134 body both retains the torque tube 132 and serves as a directional guide to the mechanical curve drilling tool assembly 140.

B. Compression and tensile loads are transferred through the torque tube 132, not the non-rotating sleeve 134.

C. The non-rotating sleeve 134 engages the torque tube 132 to maintain relative vertical positioning.

D. The torque tube 132 provides a conduit for fluid circulation.

E. A plurality of stabilizers or orientation keys 138 are spaced along the length of the non-rotating sleeve 134 so that a set of stabilizers 138 is always engaged with the keyed profile through the on-off guide tool 124, thereby maintaining the orientation of the mechanical curve drilling tool assembly 140 as the curved hole 150 is made.

F. The mechanical curve drilling tool assembly 140 (FIG. 10) provides the proper geometry bend angle and length in relation to bit tool diameter to create a predictable rate of build or arcuate turn in the curved hole 150 being drilled. A predictable rate of build coupled with a mechanically fixed angular orientation eliminates the need for surveying while drilling the curved section of the hole 150. In the mechanical curve drilling tool assembly shown n FIG. 10, this mechanically fixed angular orientation is 1½°.

G. The non-rotating sleeve 134 may incorporate articulated joints to transmit torque through the bend in the on-off guide tool 124 without putting excessive axial or bending loads on the non-rotating sleeve 134 body.

H. A plurality of stabilizers 138 on the non-rotating sleeve body facilitates the directional alignment of the mechanical curve drilling tool assembly 140 while at the same time providing structural support.

I. The plurality of stabilizers 138 facilitate the normal bending of non-rotating sleeve 134 and the torque tube 132 through the on-off guide tool 124 and the window turning shoe 110 and the curved section of well bore 150. The stabilizers 160 and 162 (FIG. 10) on the mechanical curve drilling assembly 140 also assist in guiding the bit 123 in a curved path.

J. The on-off guide tool 124 serves as an orientation guide for non-rotating sleeve 134.

K. The on-off guide tool 124 is unlatched from the window turning shoe 110 and lifted out of the hole 100 by the mating surface (not shown) on the mechanical curve drilling tool assembly 140.

FEATURES AND ADVANTAGES OF THE MUD MOTOR DRIVEN CURVE DRILLING TOOL ASSEMBLY

A. A stabilized tube 135 serves as a directional guide to the mud motor driven drilling tool assembly 144.

B. A stabilized tube 135 provides a conduit for fluid circulation.

C. A plurality of stabilizers or orientation keys 136 are spaced out along the length of the stabilized tube 135 so that a set of stabilizers is always engaged with the inside of the on-off guide tool 124, thereby maintaining the orientation of the mud motor driven drilling tool 144 as it passes through the on-off guide tool 124 as the arcuate hole 150 is being drilled.

D. The mud motor driven drilling tool assembly 144 provides the proper geometry to create a predictable rate of build or turn in the arcuate hole 150 being drilled. A predictable rate of build coupled with a mechanically fixed orientation eliminates the need for surveying while drilling the curved or arcuate section 150 away from the original hole 100.

E. A plurality of stabilizers 136 facilitates the normal bending of the stabilized tube 135 through the window turning shoe 110 and the curved section of well bore 150. This will reduce drag and increase fatigue life.

F. The on-off guide tool 124 serves as an orientation guide for the stabilized tube 135.

G. The on-off guide tool 124 is unlatched from the window turning shoe 110 and lifted out of the hole 100 by the mating surface (not shown) on the mud motor driven drilling tool assembly 144.

It will be apparent to those skilled in the art that various changes may be made to the disclosed apparatus and method without departing from the spirit and scope thereof and therefore the invention is not limited by that which is disclosed in the drawings and specification but only as indicated in the appended claims.

What is claimed is:

1. A method for forming a lateral bore hole away from a casing lined original well bore, said method comprising:

inserting a window turning shoe with a window milling assembly into the original well bore at a first predetermined directional orientation;

milling a window in the casing using said window mill;

removing said window milling assembly from the original well bore leaving said window turning shoe in place in the well bore;

inserting a guide tool and a mechanical curve drilling assembly into said window turning shoe;

latching said guide tool with a second predetermined directional orientation into said window turning shoe;

drilling a curved hole away from the original well bore using said curve drilling assembly;

removing said guide tool and said curve drilling assembly from said window turning shoe;

inserting a conventional drilling apparatus into said original well bore, past said window turning shoe and through said curved hole;

drilling a lateral bore hole away from said original well bore using said conventional drilling apparatus.

2. The method as defined in claim 1 wherein said first predetermined directional orientation is established by engagement of said window turning shoe with a packer in the vertical well bore.

3. A system for drilling a curved hole through the casing of an original well bore, said system comprising:

a window turning shoe constructed and arranged to be positionable at a predetermined depth and directional orientation with respect to said original well bore;

means for drilling the curved hole including:

a guide tool constructed and arranged to engage and be directionally oriented by said window turning shoe;

a non-rotating sleeve body constructed and arranged to be guided by said guide tool;

a torque tube constructed and arranged to pass through said non-rotating sleeve body; and a rotary drilling apparatus constructed and arranged to be driven by said torque tube and to drill a curved hole.

4. The system as defined in claim 3 further including a window mill, said window mill being constructed and arranged to mill a window in the casing to allow for the drilling of the curved hole when the window mill is oriented by said window turning shoe.

5. The system as defined in claim 3 wherein said guide tool is latched to said window turning shoe.

6. The system as defined in claim 3 further including conventional drilling apparatus for drilling a directional or horizontal hole extending outwardly from the curved hole.

7. A system for drilling a curved hole through the casing of an original well bore, said system comprising:

a window turning shoe constructed and arranged to be positionable at a predetermined depth and directional orientation with respect to said original well bore;

means for drilling the curved hole including:

a guide tool constructed and arranged to engage and be directionally oriented by said window turning shoe;

a non-rotating sleeve body constructed and arranged to be guided by said guide tool;

a stabilized tube constructed and arranged to be guided by said guide tube; and a mud motor drilling apparatus constructed and arranged to be driven by said stabilized tube and to drill a curved hole.

* * * * *